US010279381B1

(12) United States Patent
Denison

(10) Patent No.: US 10,279,381 B1
(45) Date of Patent: May 7, 2019

(54) FIREARM CLEANING DEVICE

(71) Applicant: Jeffery Denison, Chewelah, WA (US)

(72) Inventor: Jeffery Denison, Chewelah, WA (US)

( * ) Notice: Subject to any disclaimer, the term of this patent is extended or adjusted under 35 U.S.C. 154(b) by 0 days.

(21) Appl. No.: 15/936,869

(22) Filed: Mar. 27, 2018

(51) Int. Cl.
*F41A 29/02* (2006.01)
*B08B 9/045* (2006.01)

(52) U.S. Cl.
CPC ..... *B08B 9/045* (2013.01); *F41A 29/02* (2013.01)

(58) Field of Classification Search
CPC ..... F41A 29/02; F41A 29/00; F41A 29/04; B08B 9/00; B08B 9/04; B08B 9/045; A46B 2200/3013
See application file for complete search history.

(56) References Cited

U.S. PATENT DOCUMENTS 202,361 A * 4/1878 Miller ..... A46B 3/18 15/104.2
1,258,737 A * 3/1918 Bemis ..... A46B 3/18 15/104.2
1,522,837 A * 1/1925 Rebar ..... F41A 29/02 15/104.16
1,796,337 A * 3/1931 Moore ..... F28G 3/04 118/DIG. 10
2,379,962 A * 7/1945 Hoerle ..... F41A 29/02 15/104.165
2,824,322 A 2/1958 Angelica
3,402,950 A * 9/1968 Hertzberg ..... F41A 29/02 15/104.2
3,814,525 A * 6/1974 Spencer ..... F41A 29/04 15/104.165
5,557,871 A 9/1996 LaLonde
5,628,136 A * 5/1997 Wickser, Jr. ..... F41A 29/02 42/95
D562,935 S 2/2008 Morgan
8,250,800 B1 8/2012 Johnson
8,458,845 B1 * 6/2013 Tabieros ..... A46B 5/0095 15/104.05
8,567,107 B1 * 10/2013 Bascue ..... F41A 29/02 15/104.16
8,863,432 B2 10/2014 An
9,057,575 B2 * 6/2015 Shipman ..... F41A 29/02
2006/0130251 A1 * 6/2006 Bourrelly ..... B08B 9/021 15/104.09
2006/0236584 A1 * 10/2006 Williams ..... F41A 29/00 42/95
2012/0186128 A1 * 7/2012 Williams ..... F41A 9/02 42/95

(Continued)

FOREIGN PATENT DOCUMENTS

CH 423547 A * 10/1966 ..... F41A 29/02
FR 2850887 A1 * 8/2004 ..... B08B 9/021

(Continued)

*Primary Examiner* — Benjamin P Lee

(57) ABSTRACT

A firearm cleaning device for cleaning a chamber of a firearm includes a rod and a first disk that is selectively couplable by a first face to a first end of the rod. A plurality of first bristles is coupled to and extends radially from an outer perimeter of the first disk. The rod is configured to be grasped in a hand of a user to insert the first disk into a chamber of a weapon. The rod is positioned to rotate the first disk within the chamber so that the first bristles are rotated within the chamber to loosen debris that is adhered to interior surfaces of the chamber.

18 Claims, 6 Drawing Sheets

(56) References Cited

U.S. PATENT DOCUMENTS

| | | | | |
|---|---|---|---|---|
| 2012/0291803 | A1* | 11/2012 | Shipman | F41A 29/02 134/8 |
| 2013/0239452 | A1* | 9/2013 | Sohn | F41A 29/02 42/95 |
| 2013/0269234 | A1* | 10/2013 | Williams | F41A 29/02 42/95 |
| 2015/0354914 | A1 | 12/2015 | Otter | |
| 2017/0254611 | A1* | 9/2017 | Rambo | F41A 29/02 |

FOREIGN PATENT DOCUMENTS

| | | | | |
|---|---|---|---|---|
| JP | 2008101889 | A * | 5/2008 | F41A 29/02 |
| KR | 101058503 | B1 * | 8/2011 | F41A 29/02 |
| WO | WO2012097307 | | 7/2012 | |

* cited by examiner

FIREARM CLEANING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cleaning devices and more particularly pertains to a new cleaning device for cleaning a chamber of a firearm.

BRIEF SUMMARY OF THE INVENTION

An embodiment of the disclosure meets the needs presented above by generally comprising a rod and a first disk that is selectively couplable by a first face to a first end of the rod. A plurality of first bristles is coupled to and extends radially from an outer perimeter of the first disk. The rod is configured to be grasped in a hand of a user to insert the first disk into a chamber of a weapon. The rod is positioned to rotate the first disk within the chamber so that the first bristles are rotated within the chamber to loosen debris that is adhered to interior surfaces of the chamber.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
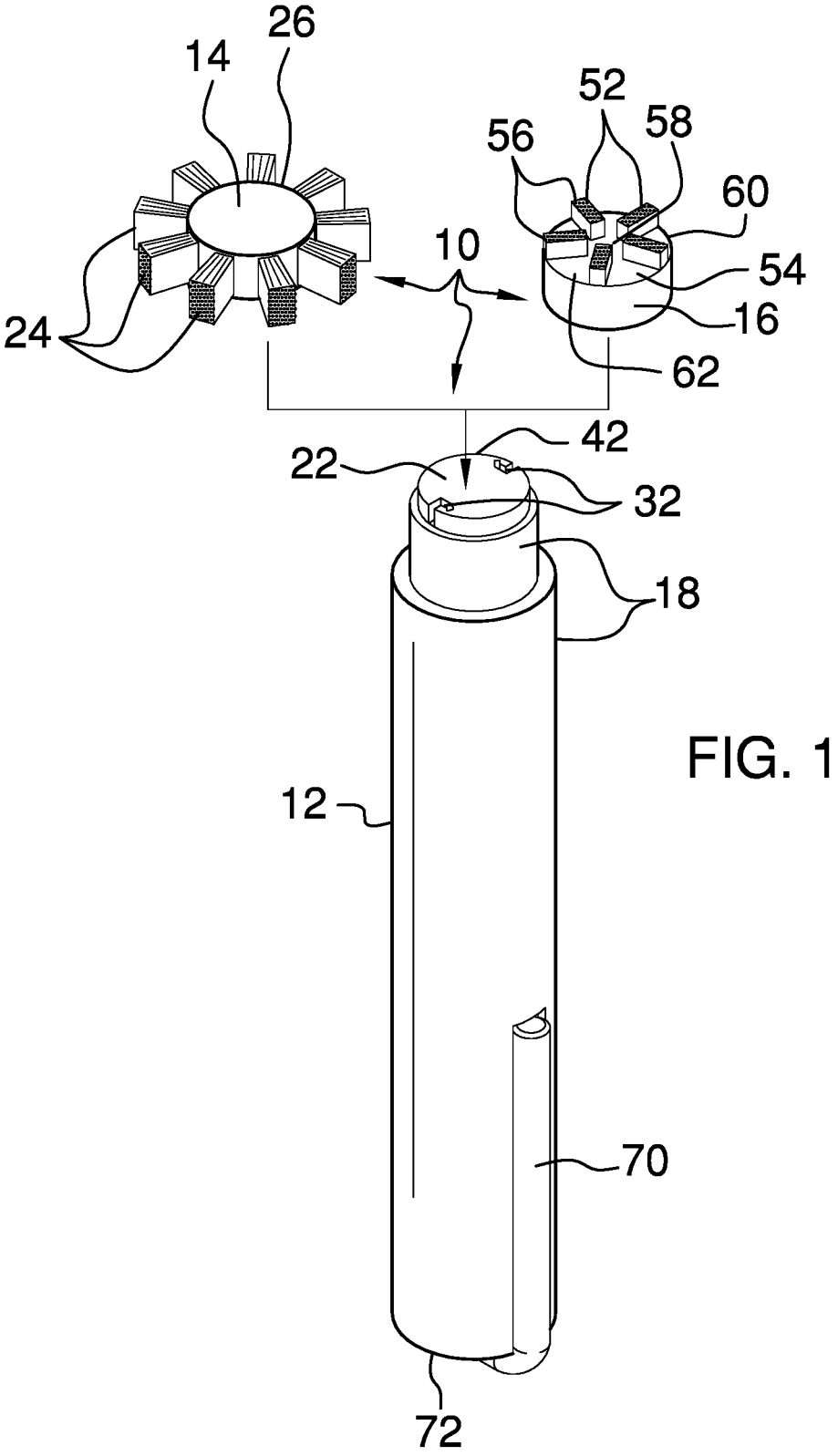
FIG. 1 is an isometric perspective view of a firearm cleaning device according to an embodiment of the disclosure.

With reference now to the drawings, and in particular to FIGS. 1 through 6 thereof, a new cleaning device embodying the principles and concepts of an embodiment of the disclosure and generally designated by the reference numeral 10 will be described.

Figure 2:
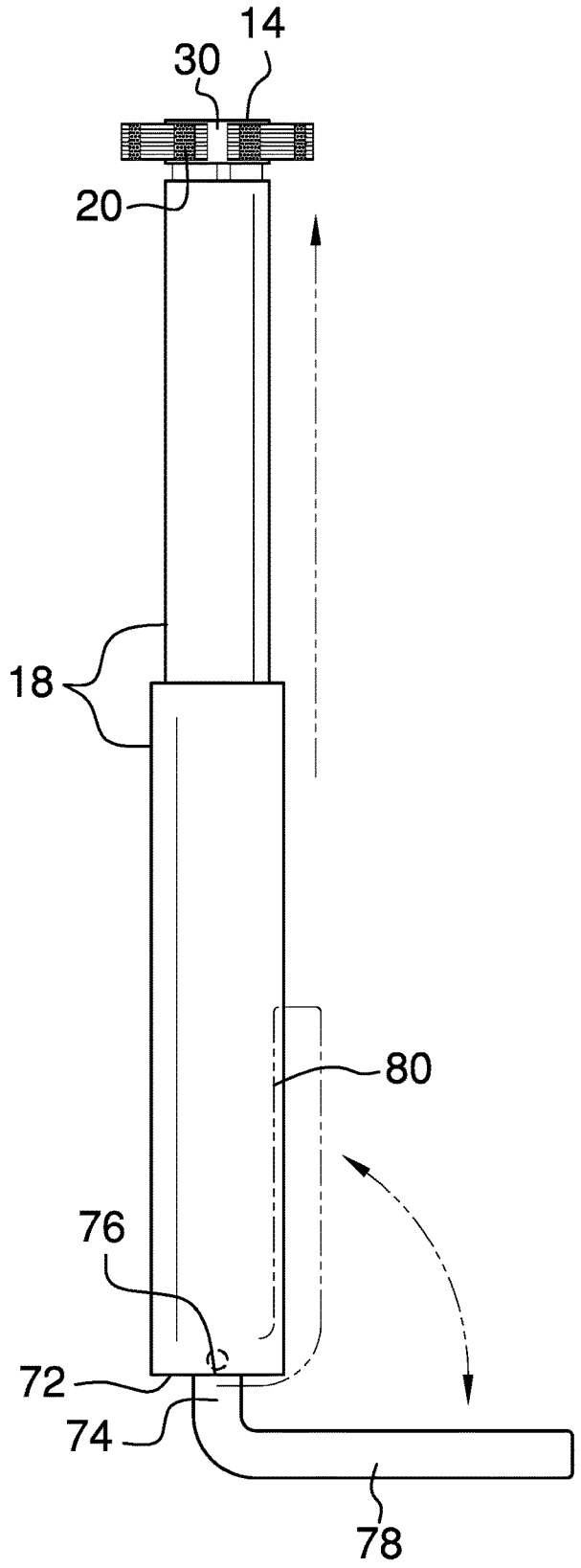
FIG. 2 is a front view of an embodiment of the disclosure.
Figure 3:
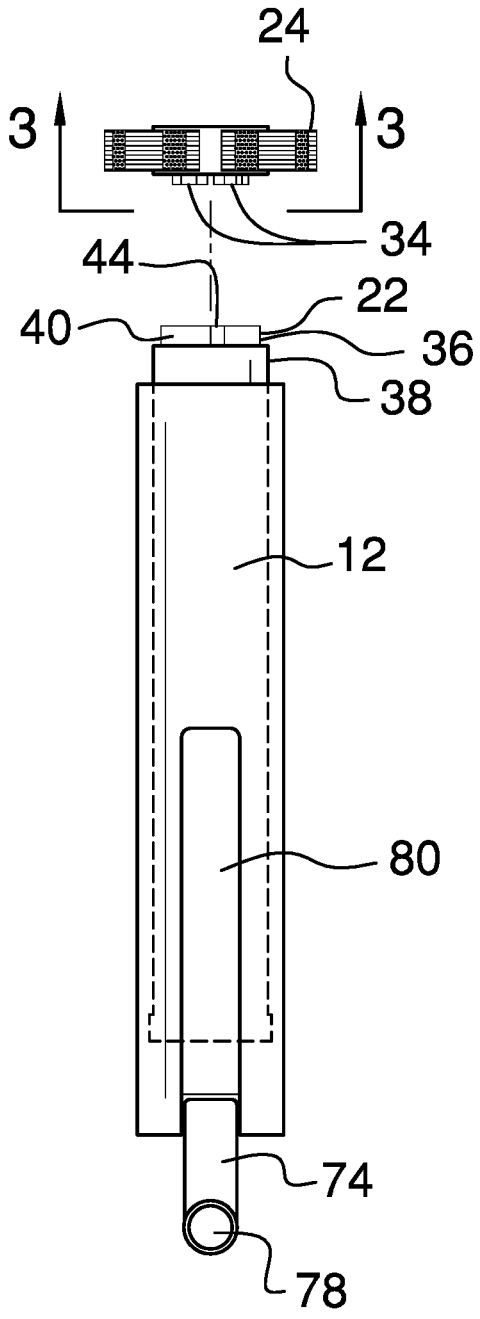
FIG. 3 is a side view of an embodiment of the disclosure.

As best illustrated in FIGS. 1 through 6, the firearm cleaning device 10 generally comprises a rod 12, a first disk 14, and a second disk 16. The rod 12 comprises a plurality of nested sections 18 so that the rod 12 is selectively extensible, as shown in FIG. 2. The plurality of nested sections 18 comprises two nested sections 18. The rod 12 is circularly shaped when viewed longitudinally. The rod 12 comprises carbon fiber.

Figure 6:
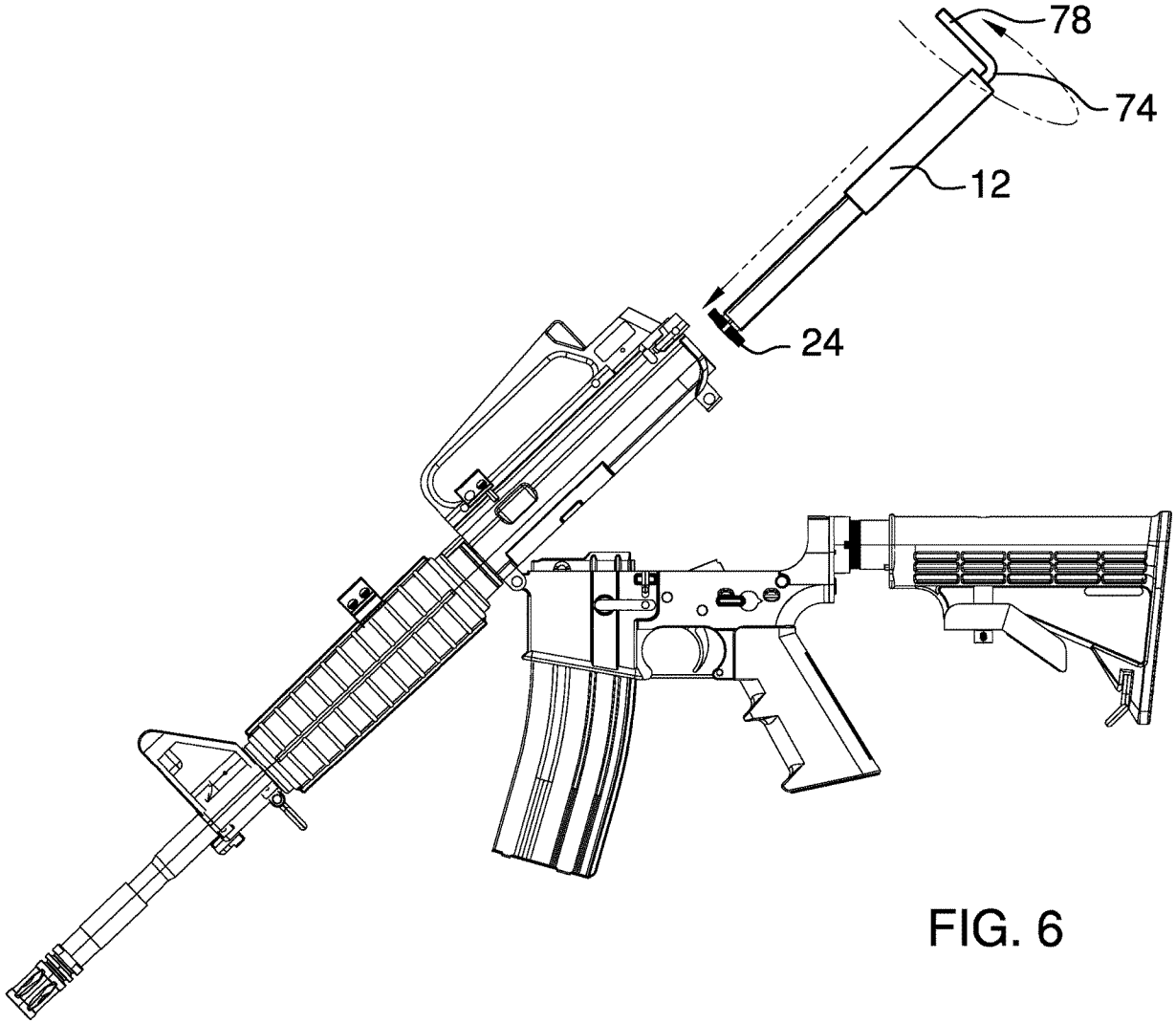
FIG. 6 is an in-use view of an embodiment of the disclosure.

The first disk 14 is selectively couplable by a first face 20 to a first end 22 of the rod 12. The rod 12 is configured to be grasped in a hand of a user to insert the first disk 14 into a chamber of a weapon, as shown in FIG. 6. The rod 12 is positioned to rotate the first disk 14 within the chamber.

A plurality of first bristles 24 is coupled to and extends radially from an outer perimeter 26 of the first disk 14. The first disk 14 and the plurality of first bristles 24 are constructed to match the caliber of the firearm to be cleaned. The rod 12 is configured to rotate the first bristles 24 within the chamber to loosen debris that is adhered to interior surfaces of the chamber. The plurality of first bristles 24 is positioned in a plurality of first groups 28. Adjacent first groups 28 are separated by a first void 30. The plurality of first groups 28 comprises from four to twelve first groups 28. The plurality of first groups 28 comprises from six to ten first groups 28. In one embodiment, as shown in FIG. 1, the plurality of first groups 28 comprises nine first groups 28.

A plurality of first couplers 32 is coupled to the first end 22 of the rod 12. A plurality of second couplers 34 is coupled to the first face 20 of the first disk 14. The second couplers 34 are complementary to the first couplers 32. Each second coupler 34 is positioned to couple to a respective first coupler 32 to couple the first disk 14 to the rod 12.

A first recess 36 extends into an outer circumference 38 of the rod 12 adjacent to the first end 22 and defines a peg 40. The plurality of first couplers 32 comprises two first couplers 32 that are opposingly positioned on a circumference 42 of the peg 40. Each first coupler 32 comprises a slot 44 that extends into the peg 40 from the first end 22. The slots 44 are substantially L-shaped when viewed from the first end 22. The slots 44 extend to the circumference 42 of the peg 40.

Figure 4A:
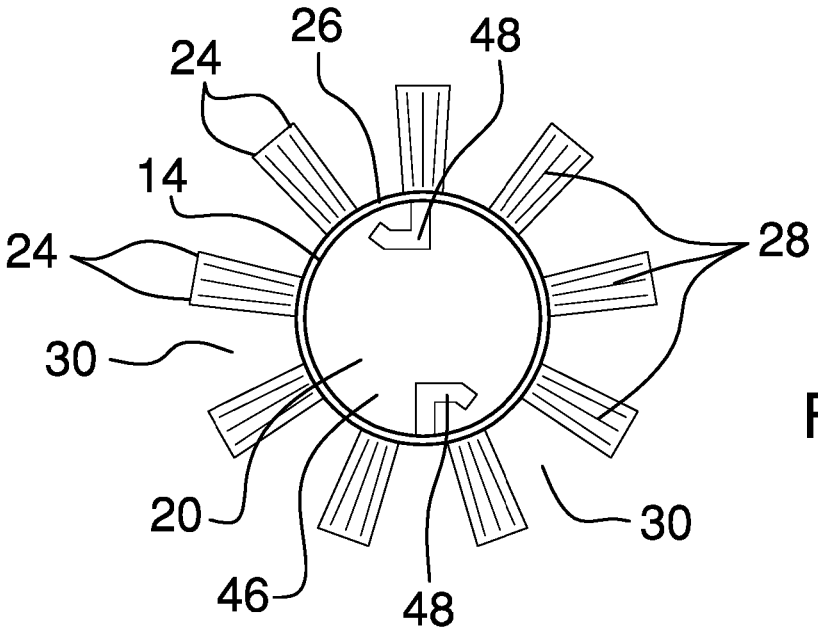
FIGS. 4A and 4B are a bottom views of an embodiment of the disclosure.

A second recess 46 is positioned in the first face 20 of the first disk 14, as shown in FIG. 4A. The second recess 46 is complementary to the peg 40. The second recess 46 is positioned to insert the peg 40 to frictionally couple the first disk 14 to the rod 12. Each second coupler 34 comprises a first tab 48 that is coupled to the first disk 14 and extends into the second recess 46. The first tabs 48 are complementary to the slots 44. Each first tab 48 is positioned to be inserted into a respective slot 44 as the peg 40 is inserted into the second recess 46 to couple the first disk 14 to the rod 12. The first disk 14 is positioned to be rotated coincident with the rod 12.

Figure 5:
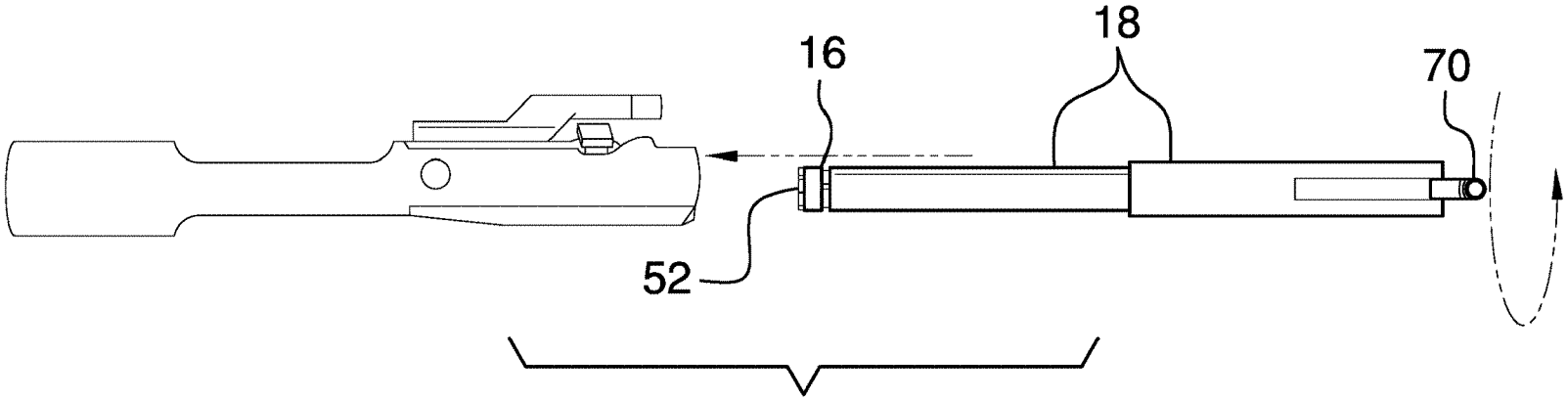
FIG. 5 is an in-use view of an embodiment of the disclosure.

The second disk 16 is selectively couplable by a lower face 50 to the first end 22 of the rod 12. The rod 12 is configured to be grasped in the hand of the user to insert the second disk 16 into a bolt carrier of the weapon, as shown in FIG. 5, so that the second disk 16 is positioned proximate to a bolt stop of the weapon. The second disk 16 is constructed to match the caliber of the firearm to be cleaned. The rod 12 is positioned to rotate the second disk 16 within the bolt carrier.

A plurality of second bristles 52 is coupled to and extends perpendicularly from an upper face 54 of the second disk 16. The rod 12 is positioned to rotate the second bristles 52 against the bolt stop. The second bristles 52 are configured to loosen debris that is adhered to the bolt stop.

The plurality of second bristles 52 is positioned in a plurality of second groups 56. Each second group 56 extends radially from proximate to a center 58 of the upper face 54 to an edge 60 of the second disk 16. Adjacent second groups 56 are separated by a second void 62. The plurality of second groups 56 comprises from three to seven second groups 56. The plurality of second groups 56 comprises from four to six second groups 56. In one embodiment, as shown in FIG. 1, the plurality of second groups 56 comprises five second groups 56.

A plurality of third couplers 64 is coupled to the lower face 50 of the second disk 16. The third couplers 64 are complementary to the first couplers 32. Each third coupler 64 is positioned to couple to a respective first coupler 32 to couple the second disk 16 to the rod 12.

Figure 4B:
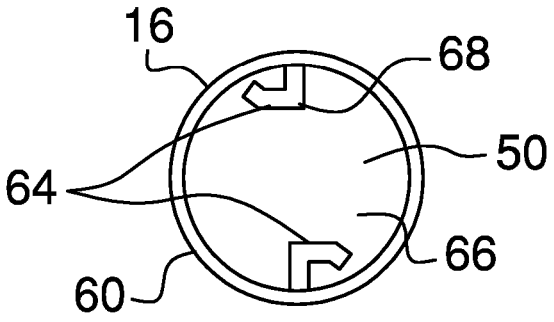

A third recess 66 is positioned in the lower face 50 of the second disk 16, as shown in FIG. 4B. The third recess 66 is complementary to the peg 40. The third recess 66 is positioned to insert the peg 40 to frictionally couple the second disk 16 to the rod 12. Each third coupler 64 comprises a second tab 68 that is coupled to the second disk 16 and extends into the third recess 66. The second tabs 68 are complementary to the slots 44. Each second tab 68 is positioned to be inserted into a respective slot 44 as the peg 40 is inserted into the third recess 66 to couple the second disk 16 to the rod 12 so that the second disk 16 is positioned to rotate coincident with the rod 12.

A handle 70 is coupled to and is selectively extensible from a second end 72 of the rod 12 so that the handle 70 is positioned substantially perpendicularly to the rod 12. The handle 70 is configured to be grasped in the hand of the user to selectively rotate the rod 12 within the chamber and the bolt carrier of the weapon.

The handle 70 comprises a first bar 74 that is pivotally coupled to and extends from a center point 76 of the second end 72 of the rod 12. The first bar 74 is selectively positionable to extend linearly from the rod 12 and to extend radially from the center point 76 to the outer circumference 38 of the rod 12, as shown in FIG. 2. A second bar 78 is coupled to and extends perpendicularly from the first bar 74 distal from the center point 76. The second bar 78 is selectively positionable in a stowed configuration wherein the second bar 78 is adjacent to the rod 12. The second bar 78 also is selectively positionable in an extended configuration wherein the second bar 78 is perpendicular to the rod 12 and is configured to be grasped in the hand of the user to selectively rotate the rod 12 within the chamber and the bolt carrier of the weapon. The first bar 74 and the second bar 78 are circularly shaped when viewed longitudinally.

A fourth recess 80 is positioned in the rod 12. The fourth recess 80 is substantially complementary to the handle 70. The fourth recess 80 is positioned to partially insert the first bar 74 and the second bar 78 as the second bar 78 is positioned in the stowed configuration, as shown in FIG. 2.

In use, the rod 12 is configured to be grasped in the hand of the user to insert the first disk 14 into the chamber of the weapon. The handle 70 is positioned to rotate rod 12 and the first disk 14 within the chamber so that the first bristles 24 are rotated within the chamber to loosen the debris that is adhered to the interior surfaces of the chamber. With the second disk 16 coupled to the rod 12, the rod 12 is configured to be grasped in the hand of the user to insert the second disk 16 into the bolt carrier of the weapon so that the second disk 16 is positioned proximate to the bolt stop of the weapon. The handle 70 is positioned to rotate rod 12 and the second disk 16 within the bolt carrier so that the second bristles 52 are rotated against the bolt stop to loosen the debris that is adhered to the bolt stop.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A firearm cleaning device comprising:

a rod;

a first disk selectively couplable by a first face to a first end of said rod;

a plurality of first bristles coupled to and extending radially from an outer perimeter of said first disk;

wherein said first disk is positioned on said rod such that said rod is configured for grasping in a hand of a user for inserting said first disk into a chamber of a weapon such that said rod is positioned for rotating said first disk within the chamber, wherein said first bristles are positioned on said first disk such that said rod is configured for rotating said first bristles within the chamber for loosening debris adhering to interior surfaces of the chamber;

a plurality of first couplers coupled to said first end of said rod;

a plurality of second couplers coupled to said first face of said first disk, said second couplers being complementary to said first couplers;

wherein said second couplers are positioned on said first disk such that each said second coupler is positioned for coupling to a respective said first coupler for coupling said first disk to said rod;

a first recess extending into an outer circumference of said rod adjacent to said first end defining a peg; and said plurality of first couplers comprising two said first couplers opposingly positioned on a circumference of said peg, each said first coupler comprising a slot extending into said peg from said first end, said slots being substantially L-shaped when viewed from said first end, said slots extending to said circumference of said peg.

2. The device of claim 1, further including said rod comprising a plurality of nested sections such that said rod is selectively extensible, said plurality of nested sections comprising two said nested sections.

3. The device of claim 1, further including said rod being circularly shaped when viewed longitudinally.

4. The device of claim 1, further including said rod comprising carbon fiber.

5. The device of claim 1, further including said plurality of first bristles being positioned in a plurality of first groups such that adjacent said first groups are separated by a first void, said plurality of first groups comprising from four to twelve said first groups.

6. The device of claim 5, further including said plurality of first groups comprising from six to ten said first groups.

7. The device of claim 6, further including said plurality of first groups comprising nine said first groups.

8. The device of claim 1, further comprising:

a second recess positioned in said first face of said first disk, said second recess being complementary to said peg;

each said second coupler comprising a first tab coupled to said first disk and extending into said second recess, said first tabs being complementary to said slots; and wherein said second recess is positioned in said first disk such that said second recess is positioned for inserting said peg for frictionally coupling said first disk to said rod, wherein said first tabs are positioned on said first disk such that each said first tab is positioned for inserting into a respective said slot as said peg is inserted into said second recess for coupling said first disk to said rod such that said first disk is positioned for rotating coincident with said rod.

9. The device of claim 1, further comprising:

a second disk selectively couplable by a lower face to said first end of said rod;

a plurality of second bristles coupled to and extending perpendicularly from an upper face of said second disk; and wherein said second disk is positioned on said rod such that said rod is configured for grasping in the hand of the user for inserting said second disk into a bolt carrier of the weapon, such that said second disk is positioned proximate to a bolt stop of the weapon, wherein said rod is positioned for rotating said second disk within the bolt carrier, wherein said second bristles are positioned on said second disk such that said rod is positioned for rotating said second bristles against the bolt stop such that said second bristles are configured for loosening debris adhering to the bolt stop.

10. The device of claim 9, further including said plurality of second bristles being positioned in a plurality of second groups, each said second group extending radially from proximate to a center of said upper face to an edge of said second disk such that adjacent said second groups are separated by a second void, said plurality of second groups comprising from three to seven said second groups.

11. The device of claim 10, further including said plurality of second groups comprising from four to six said second groups.

12. The device of claim 11, further including said plurality of second groups comprising five said second groups.

13. The device of claim 9, further including a plurality of third couplers coupled to said lower face of said second disk, said third couplers being complementary to said first couplers, wherein said third couplers are positioned on said second disk such that each said third coupler is positioned for coupling to a respective said first coupler for coupling said second disk to said rod.

14. The device of claim 13, further comprising:

a third recess positioned in said lower face of said second disk, said third recess being complementary to said peg;

each said third coupler comprising a second tab coupled to said second disk and extending into said third recess, said second tabs being complementary to said slots; and wherein said third recess is positioned in said second disk such that said third recess is positioned for inserting said peg for frictionally coupling said second disk to said rod, wherein said second tabs are positioned on said second disk such that each said second tab is positioned for inserting into a respective said slot as said peg is inserted into said third recess for coupling said second disk to said rod such that said second disk is positioned for rotating coincident with said rod.

15. The device of claim 1, further including a handle coupled to and selectively extensible from a second end of said rod such that said handle is positioned substantially perpendicularly to said rod, wherein said handle is positioned on said rod such that said handle is configured for grasping in the hand of the user for selectively rotating said rod within the chamber and the bolt carrier of the weapon.

16. The device of claim 15, further including said handle comprising:

a first bar pivotally coupled to and extending from a center point of said second end of said rod such that said first bar is selectively positionable for extending linearly from said rod and for extending radially from said center point to said outer circumference of said rod;

a second bar coupled to and extending perpendicularly from said first bar distal from said center point, said first bar and said second bar being circularly shaped when viewed longitudinally; and wherein said second bar is selectively positionable in a stowed configuration, wherein said second bar is adjacent to said rod, and an extended configuration, wherein said second bar is perpendicular to said rod and configured for grasping in the hand of the user for selectively rotating said rod within the chamber and the bolt carrier of the weapon.

17. A firearm cleaning device comprising:

a rod;

a first disk selectively couplable by a first face to a first end of said rod;

a plurality of first bristles coupled to and extending radially from an outer perimeter of said first disk;

wherein said first disk is positioned on said rod such that said rod is configured for grasping in a hand of a user for inserting said first disk into a chamber of a weapon such that said rod is positioned for rotating said first disk within the chamber, wherein said first bristles are positioned on said first disk such that said rod is configured for rotating said first bristles within the chamber for loosening debris adhering to interior surfaces of the chamber;

a handle coupled to and selectively extensible from a second end of said rod such that said handle is positioned substantially perpendicularly to said rod, wherein said handle is positioned on said rod such that said handle is configured for grasping in the hand of the user for selectively rotating said rod within the chamber and the bolt carrier of the weapon, said handle comprising a first bar pivotally coupled to and extending from a center point of said second end of said rod such that said first bar is selectively positionable for extending linearly from said rod and for extending radially from said center point to said outer circumference of said rod;

a second bar coupled to and extending perpendicularly from said first bar distal from said center point, said first bar and said second bar being circularly shaped when viewed longitudinally; and wherein said second bar is selectively positionable in a stowed configuration, wherein said second bar is adjacent to said rod, and an extended configuration, wherein said second bar is perpendicular to said rod and configured for grasping in the hand of the user for selectively rotating said rod within the chamber and the bolt carrier of the weapon; and a fourth recess positioned in said rod, said fourth recess being substantially complementary to said handle such that said fourth recess is positioned for partially inserting said first bar and said second bar as said second bar is positioned in the stowed configuration.

18. A firearm cleaning device comprising:

a rod, said rod comprising a plurality of nested sections such that said rod is selectively extensible, said plurality of nested sections comprising two said nested sections, said rod being circularly shaped when viewed longitudinally, said rod comprising carbon fiber;

a first disk selectively couplable by a first face to a first end of said rod, wherein said first disk is positioned on said rod such that said rod is configured for grasping in a hand of a user for inserting said first disk into a chamber of a weapon such that said rod is positioned for rotating said first disk within the chamber;

a plurality of first bristles coupled to and extending radially from an outer perimeter of said first disk, wherein said first bristles are positioned on said first disk such that said rod is configured for rotating said first bristles within the chamber for loosening debris adhering to interior surfaces of the chamber, said plurality of first bristles being positioned in a plurality of first groups such that adjacent said first groups are separated by a first void, said plurality of first groups comprising from four to twelve said first groups, said plurality of first groups comprising from six to ten said first groups, said plurality of first groups comprising nine said first groups;

a plurality of first couplers coupled to said first end of said rod;

a first recess extending into an outer circumference of said rod adjacent to said first end defining a peg, said plurality of first couplers comprising two said first couplers opposingly positioned on a circumference of said peg, each said first coupler comprising a slot extending into said peg from said first end, said slots being substantially L-shaped when viewed from said first end, said slots extending to said circumference of said peg;

a plurality of second couplers coupled to said first face of said first disk, said second couplers being complementary to said first couplers, wherein said second couplers are positioned on said first disk such that each said second coupler is positioned for coupling to a respective said first coupler for coupling said first disk to said rod;

a second recess positioned in said first face of said first disk, said second recess being complementary to said peg, wherein said second recess is positioned in said first disk such that said second recess is positioned for inserting said peg for frictionally coupling said first disk to said rod, each said second coupler comprising a first tab coupled to said first disk and extending into said second recess, said first tabs being complementary to said slots, wherein said first tabs are positioned on said first disk such that each said first tab is positioned for inserting into a respective said slot as said peg is inserted into said second recess for coupling said first disk to said rod such that said first disk is positioned for rotating coincident with said rod;

a second disk selectively couplable by a lower face to said first end of said rod, wherein said second disk is positioned on said rod such that said rod is configured for grasping in the hand of the user for inserting said second disk into a bolt carrier of the weapon, such that said second disk is positioned proximate to a bolt stop of the weapon, wherein said rod is positioned for rotating said second disk within the bolt carrier;

a plurality of second bristles coupled to and extending perpendicularly from an upper face of said second disk, wherein said second bristles are positioned on said second disk such that said rod is positioned for rotating said second bristles against the bolt stop such that said second bristles are configured for loosening debris adhering to the bolt stop, said plurality of second bristles being positioned in a plurality of second groups, each said second group extending radially from proximate to a center of said upper face to an edge of said second disk such that adjacent said second groups are separated by a second void, said plurality of second groups comprising from three to seven said second groups, said plurality of second groups comprising from four to six said second groups, said plurality of second groups comprising five said second groups;

a plurality of third couplers coupled to said lower face of said second disk, said third couplers being complementary to said first couplers, wherein said third couplers are positioned on said second disk such that each said third coupler is positioned for coupling to a respective said first coupler for coupling said second disk to said rod;

a third recess positioned in said lower face of said second disk, said third recess being complementary to said peg, wherein said third recess is positioned in said second disk such that said third recess is positioned for inserting said peg for frictionally coupling said second disk to said rod, each said third coupler comprising a second tab coupled to said second disk and extending into said third recess, said second tabs being complementary to said slots, wherein said second tabs are positioned on said second disk such that each said second tab is positioned for inserting into a respective said slot as said peg is inserted into said third recess for coupling said second disk to said rod such that said second disk is positioned for rotating coincident with said rod;

a handle coupled to and selectively extensible from a second end of said rod such that said handle is positioned substantially perpendicularly to said rod, wherein said handle is positioned on said rod such that said handle is configured for grasping in the hand of the user for selectively rotating said rod within the chamber and the bolt carrier of the weapon, said handle comprising:

a first bar pivotally coupled to and extending from a center point of said second end of said rod such that said first bar is selectively positionable for extending linearly from said rod and for extending radially from said center point to said outer circumference of said rod, and a second bar coupled to and extending perpendicularly from said first bar distal from said center point such that said second bar is selectively positionable in a stowed configuration wherein said second bar is adjacent to said rod and an extended configuration wherein said second bar is perpendicular to said rod and configured for grasping in the hand of the user for selectively rotating said rod within the chamber and the bolt carrier of the weapon, said first bar and said second bar being circularly shaped when viewed longitudinally;

a fourth recess positioned in said rod, said fourth recess being substantially complementary to said handle such that said fourth recess is positioned for partially inserting said first bar and said second bar as said second bar is positioned in the stowed configuration; and wherein said first disk is positioned on said rod such that said rod is configured for grasping in the hand of the user for inserting said first disk into the chamber of the weapon such that said rod is positioned for rotating said first disk within the chamber, wherein said first bristles are positioned on said first disk such that said rod is configured for rotating said first bristles within the chamber for loosening the debris adhering to the interior surfaces of the chamber, wherein said second disk is positioned on said rod such that said rod is configured for grasping in the hand of the user for inserting said second disk into the bolt carrier of the weapon, such that said second disk is positioned proximate to the bolt stop of the weapon, wherein said rod is positioned for rotating said second disk within the bolt carrier, wherein said second bristles are positioned on said second disk such that said rod is positioned for rotating said second bristles against the bolt stop such that said second bristles are configured for loosening the debris adhering to the bolt stop.

* * * * *